US006739008B1

(12) United States Patent
Kindrick

(10) Patent No.: US 6,739,008 B1
(45) Date of Patent: May 25, 2004

(54) VARIABLE DENSITY THERAPEUTIC CUSHION

(76) Inventor: Sharon Elaine Kindrick, 4303 Haven Glen Dr., Kingwood, TX (US) 77339-1800

( * ) Notice: Subject to any disclaimer, the term of this patent is extended or adjusted under 35 U.S.C. 154(b) by 0 days.

(21) Appl. No.: 10/641,749

(22) Filed: Aug. 15, 2003

(51) Int. Cl.[7] ..... A47C 27/08
(52) U.S. Cl. ..... 5/655.9; 730/740
(58) Field of Search ..... 5/655.9, 718, 727, 5/728, 729, 730, 740

(56) References Cited

U.S. PATENT DOCUMENTS

| | | | | |
|---|---|---|---|---|
| 2,659,418 A | | 11/1953 | Berman | |
| 3,118,153 A | * | 1/1964 | Gardner | 428/218 |
| 3,382,511 A | | 5/1968 | Brooks | |
| 4,660,238 A | | 4/1987 | Jay | |
| 5,286,089 A | | 2/1994 | Goldman | |
| 5,294,181 A | | 3/1994 | Rose | |
| 5,389,844 A | | 2/1995 | Liu | |
| 5,636,394 A | | 6/1997 | Serda | |
| 6,009,578 A | | 1/2000 | Davis | |
| 6,230,351 B1 | | 5/2001 | Kohole | |
| 6,428,564 B1 | * | 8/2002 | Ferguson | 607/114 |

* cited by examiner

*Primary Examiner*—Teri Pham Luu
*Assistant Examiner*—Fredrick Conley
(74) *Attorney, Agent, or Firm*—Randal D. Homburg

(57) ABSTRACT

A combined and laminated padded cushioning device, adapted for use as a mattress, chair cushion or wheelchair pad, includes layers of varied densities of padding, each layer of padding having cut-out portions, depending on the therapeutic requirements of a user, the cut-out portions either being hollow voids or being filled with encapsulated gel cushions to provide additional support for affected areas on the user, again depending on the therapeutic needs of the user. The multiple padding layers are bonded together through a fabric mesh for secure bonding and strength of adhesion, and one or more removable fabric covers are applied to the cushioning device to be periodically washed and to protect the foam from wear or soiling.

10 Claims, 3 Drawing Sheets

VARIABLE DENSITY THERAPEUTIC CUSHION

I. BACKGROUND OF THE INVENTION

1. Field of Invention

A combined and laminated padded cushioning device, adapted for use as a mattress, chair cushion or wheelchair pad, includes layers of varied densities of padding, each layer of padding having cut-out portions, depending on the therapeutic requirements of a user, the cut-out portions either being hollow voids or being filled with encapsulated gel cushions to provide additional support for affected areas on the user, again depending on the therapeutic needs of the user. The multiple padding layers are bonded together through a fabric mesh for secure bonding and strength of adhesion, and one or more removable fabric covers are applied to the cushioning device to be periodically washed and to protect the foam from wear or soiling.

2. Description of Prior Art

The following United States patents were discovered and are disclosed within this application for utility patent. All relate to chair cushions which include layered sections, cut-out sections or voids filled with gel packages.

In U.S Pat. No. 6,230,351 to Kohnle, a two layered cushion, having the first layer with a plurality of transverse regions, with a first region of the same density as a second layer, is disclosed to remediate decubitus ulcers and skin breakdown by increasing the surface contact of the cushion with the skin. A wedge shaped wheelchair cushion is disclosed in U.S. Pat. No. 6,009,578 to Davis, having a plurality of gel-filled canister shaped inserts in the cushion, diminishing in density from front to back of the cushion.

A pillow having an inner core, an intermediate layer and a surface layer, the inner core formed by three different material of varied densities, the intermediate layer also having three different material of different density, the inner core, intermediate layer and surface layers all having a corrugated outer surfaces, and smooth inner surfaces, arranged to form a pillow, are disclosed in U.S. Pat. No. 5,689,884 to Liu. A mattress pad comprising a plurality of connected square gel pads is disclosed in U.S. Pat. No. 5,636,395 to Serda. In U.S. Pat. No. 5,294,181 to Rose, a folding wheelchair seat cushion is disclosed having at least three layers of different densities of foam, with the upper layer of foam having a plurality of geometrically arranged protrusions and valleys, each layer decreasing in density from top to bottom.

Sacks filled with bouncing putty under a layer of cushion material within a fabric seat cover are disclosed in U.S. Pat. No. 3,382,511 to Brooks. In U.S. Pat. No 2,659,418 to Berman, a cushion having a plurality of non-cylindrical cavities having annular integral protuberances is claimed, also having a cellular web interspersed with non-cylindrical cavities.

The present cushion device utilizes laminated layered foam, cut-out portions, a fabric matrix between each laminated layer of foam, an inner fabric cover, an intermediate fabric cover, and a washable outer fabric cover, the intermediate fabric cover and outer fabric cover including upper and lower flaps which fold into the cut-out portions and connect to each other by removable attachment means. Removable gel packets, conforming is size and shape to the cut-out portions may be installed within the cut-out portions to provide secondary support to the cushion.

II. SUMMARY OF THE INVENTION

An improved seat cushion and mattress device provides improved stable support to a user by using a multiple covered three layers of a foam cushioning material, including an upper layer and a lower layer of a lower density cushioning material surrounding a higher density intermediate layer of cushioning material, with at least one cut-out portion through one or more of the three layers of foam, adapted to provided an absence of support to a specific area of the user undergoing therapy or in need of support in areas without support in other areas. A portion of the improvement lies in the inclusion of a fabric matrix between each layer of cushioning material to provide radial strength to the adhesion between the foam layers attached together by an adhesive cement. Another portion of the improvement lies in providing three layers of surrounding fabric cover including an inner fabric cover overlying the attached layers of foam with openings to the cut-out portions in the layers of foam, an intermediate cover having upper and lower attachable first flaps adapted to the cut-out portions of the foam attached by a first removable attaching means and an outer washable fabric cover having upper and lower attachable second flaps adapted to the cut-out portions of the foam attached by a second removable attaching means. Removable gel packs may be inserted in the cutout portions of the foam for additional support.

It is the objective of the cushion device to provide this multiple layered foam cushion in a manner adapted to the therapeutic needs of a person confined to a seated or prone lying position to alleviate stress to certain areas of the body in contact with the cushion device by the inclusion of either air filled or gel filled voids in the multiple layered cushion.

A secondary objective of the invention which improves prior seat cushions and mattresses made from different layers of foam, is to include a fabric matrix in the bonding of the fabric layers by an adhesive cement to provide radial stability to the bonded layers of foam.

A third objective of the improved seat cushion or mattress is the inclusion of three layers of fabric cover to prevent soiling, staining or other damage to the layers of foam cushion, and also to provide support to the cut-out portions in the cushioning material.

III. DESCRIPTION OF THE DRAWINGS

The following drawings are submitted with this utility patent application.

FIG. 6 is a side cross section of the cushion with a gel capsule positioned within the cut-out portion of the cushion.

IV. DESCRIPTION OF THE PREFERRED EMBODIMENT

Figure 1:
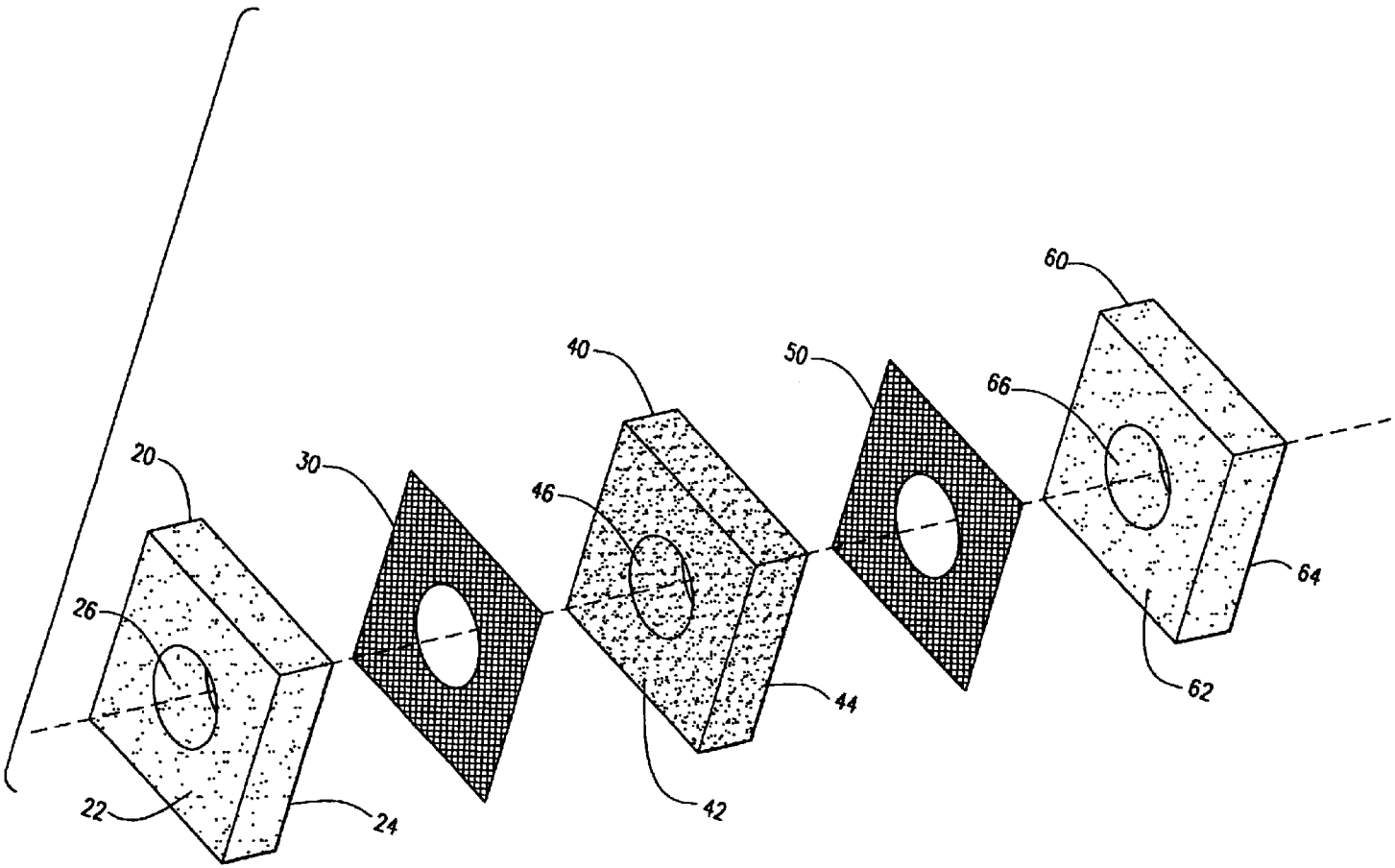
FIG. 1 is an expanded drawing of the padding layers with the fabric mesh between each padding layer.
Figure 2:
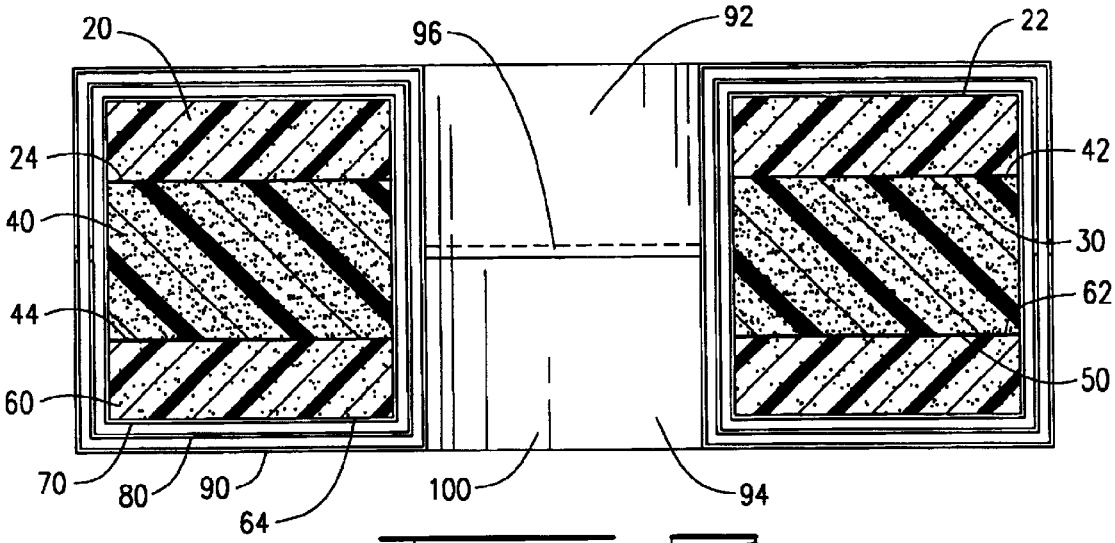
FIG. 2 is a side cross section of the cushion.
Figure 3:
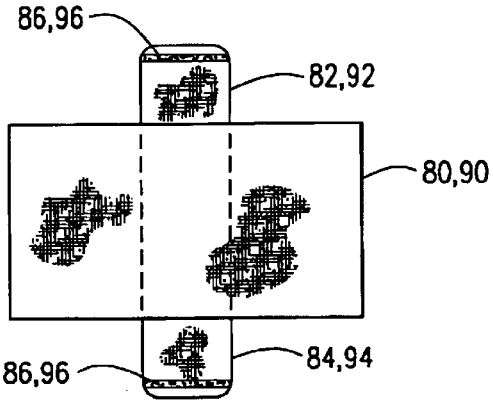
FIG. 3 is a side view of the intermediate fabric cover and the outer fabric cover with the inner sleeve portions extended outward.
Figure 4:
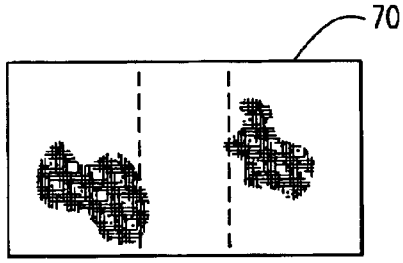
FIG. 4 is a side view of the inner fabric cover.
Figure 5:
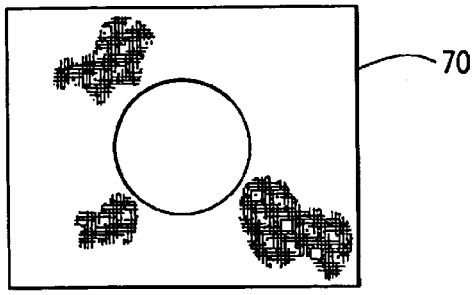
FIG. 5 is a top view of the inner fabric cover.
Figure 5:
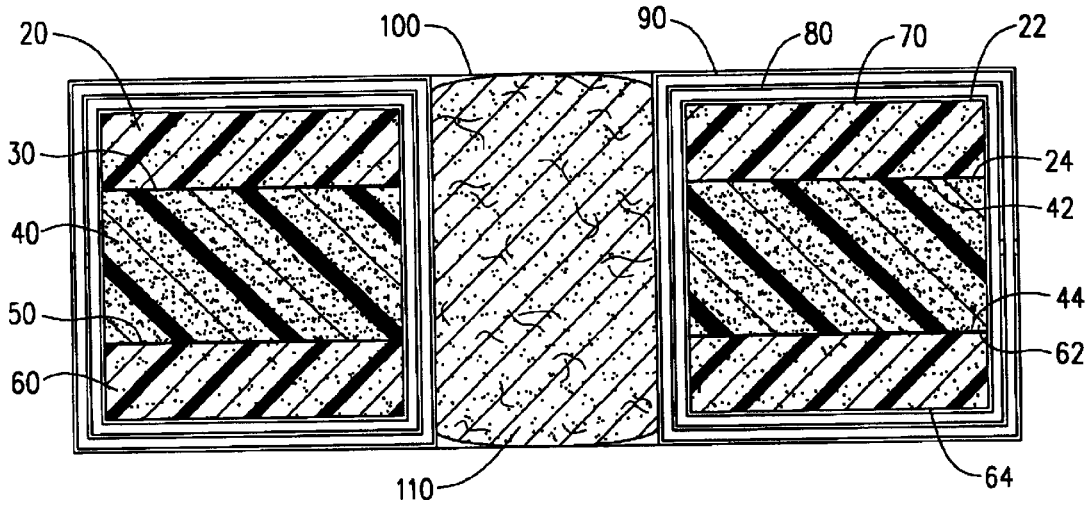

A therapeutic layered seat cushion, shown in FIGS. 1–6 of the drawings, using layers of padding of different densities bonded together through a fabric mesh, having cut-out portions to reduce contact to certain areas of the user for therapeutic purposes, comprises essentially a low density first layer padding 20 having an upper surface 22, a lower surface 24 and a cut-out portion 26, a first sheet of fabric mesh 30 bonded to the lower surface 24 of the first layer padding 20, a high density second layer padding 40, having an upper surface 42 bonded to the lower surface 24 of the first layer padding 20 through the first sheet of fabric mesh 30, a lower surface 44 and a cut-out portion 46, a second sheet of fabric mesh 50 bonded to the lower surface 44 of the second layer padding 40, a low density third layer padding 60 having an upper surface 62 bonded to the lower surface 44 of the second layer padding 40 through the second sheet of fabric mesh 50, a lower surface 64 and a cut-out portion 66, an inner fabric cover 70 adapted to cover the bonded first layer padding 20, second layer padding 40 and third layer padding 60, an intermediate fabric cover 80 fitted over the inner fabric cover 70, the intermediate cover 80 having an upper inner sleeve 82 and a lower inner sleeve 84 inserting through the cut-out portions 26, 46, 66 of the first layer padding 20, second layer padding 40 and third layer padding 60, said upper inner sleeve 82 and lower inner sleeve 84 attaching together by an attaching means 86, and a washable outer fabric cover 90 fitted over the intermediate fabric cover 80, the outer fabric cover 90 having an outer upper inner sleeve 92 and an outer lower inner sleeve 94 applied over the upper inner sleeve 82 and lower inner sleeve 84 of the intermediate fabric cover 80, said outer upper inner sleeve 92 and outer lower inner sleeve 94 also attaching together by an attaching means 96.

More specifically, the first layer padding 20 and third layer padding 60 preferably share the same density, with the second layer padding 40 having a higher density than the first layer and third layer padding 20, 60. A foam rubber material is suitable for the first, second and third layer padding. The first layer of fabric mesh 30 and second layer of fabric mesh 50 may be a nylon netting, provided to reenforce the attached padding and deter tearing, separation or uneven wear of the layers of padding, being suitably porous to allow for penetration of a bonding adhesive to connect each layer padding, embedding the fabric mesh within the bonding adhesive between the padding layers.

Figure 7:
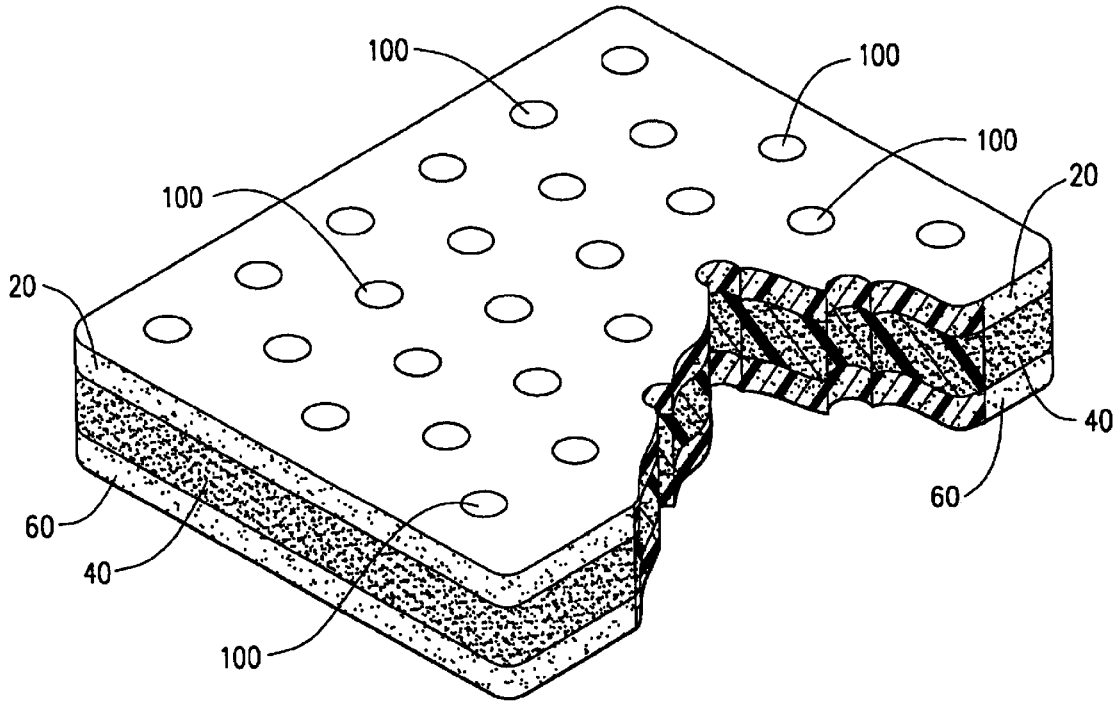
FIG. 7 is a representative drawing of a mattress utilizing the components of the cushion.

The cut-out portions 26, 46, 66 of the first layer padding 20, second layer padding 40 and third layer padding 60 should align to form a hollow void 100 in the attached layers. However, it is contemplated within the seat cushion that the cut-out portion may be in only one layer of padding and also may be only partially through one or more layers of padding. In addition, the cut-out portions may contain an encapsulated gel capsule 110, FIG. 6, occupying the cut-out portion to provide yet another density of support to the user, in certain alternative uses of the seat cushion. Also, the seat cushion may include the first layer padding 20, second layer padding 40 and third layer padding 60 having a plurality of hollow voids 100, shown in FIG. 7, wherein the seat cushion is the size of a mattress and used for persons being confined to a prone position as opposed to a seated position. It is also contemplated within the scope of this seat cushion that the cushion could be adapted for use as an arm cushion, leg cushion, or a vertically oriented cushion in addition to those included in the drawings figures.

The location of the cut-out portions may be determined by the needs of the user. For those having disease, surgical procedures or patients undergoing therapeutic treatment to certain areas of the back, pelvis, rectum, or genitalia, the cut-outs may be positioned at various locations to provide those affected areas without contact support while seated. Therefore, the cut-out portions may be of any size, shape or location within the seat cushion.

The inner fabric cover 70 is preferably a Dacron material or other sturdy moisture resisting fabric to prevent body fluids and moisture from making contact with the layers of padding. This inner fabric cover 20 preferably extends from the upper surface 22 of the first layer padding 20 to the lower surface 64 of the third layer padding 60, forming a hollow donut shaped cover over the layers of padding without any portion of the inner fabric cover intruding into the cut-out portion. The intermediate fabric cover 80 is adapted to cover the layers of padding within the inner fabric cover, the intermediate cover having an outer closeable sean. This intermediate fabric cover 80 may be provided without the upper inner sleeve 82 and lower inner sleeve 84. A cotton fabric is preferred for this intermediate fabric layer. The washable outer fabric layer 90 is adapted to cover the intermediate fabric cover 80 and also has a closeable seam. The inner fabric cover 70, the intermediate fabric cover 80 and the outer fabric cover 90, alternatively, may be irremovably attached upon the seat cushion, the outer fabric cover 90 being provided as a material suitable for external cleaning.

While the invention has been particularly shown and described with reference to a preferred embodiment thereof, it will be understood by those skilled in the art that changes in form and detail may be made therein without departing from the spirit and scope of the invention.

What is claimed is:

1. A therapeutic layered seat cushion, comprising essentially:

a low density first layer padding having an upper surface, a lower surface and a cut-out portion;

a first sheet of fabric mesh bonded to the lower surface of the first layer padding;

a high density second layer padding, having an upper surface bonded to the lower surface of the first layer padding through the first sheet of fabric mesh, a lower surface and a cut-out portion;

a second sheet of fabric mesh bonded to the lower surface of the second layer padding;

a low density third layer padding having an upper surface bonded to the lower surface of the second layer padding through the second sheet of fabric mesh, a lower surface and a cut-out portion;

an inner fabric cover to cover the bonded first layer padding, second layer padding and third layer padding;

an intermediate fabric cover fitted over the inner fabric cover having an up per inner sleeve portion and a lower inner sleeve portion inserting through the cut-out portions of the first layer padding, second layer padding and third layer padding, said upper inner sleeve and lower inner sleeve attaching together by an attaching means; and a washable outer fabric cover fitted over the internediate fabric cover, the outer fabric cover having an outer upper inner sleeve portion and an outer lower inner sleeve portion applied over the upper inner sleeve and lower inner sleeve of the intermediate fabric cover, said outer upper inner sleeve and outer lower inner sleeve also attaching together by an attaching means.

2. The seat cushion, as disclosed in claim 1 wherein:

said first layer padding and third layer padding are a foam rubber material of the same density, and said second layer padding is a foam rubber product of a higher density than that of said first layer padding and third layer padding, and said first layer and second layer of fabric mesh are nylon netting be suitably porous to allow for penetration of a bonding adhesive, embedding said fabric mesh within said bonding adhesive.

3. The cushion, as disclosed in claim 1, wherein said first layer padding, second layer padding and third padding are provided with a plurality of cut-out portions.

4. The seat cushion, as disclosed in claim 1, further comprising:

said inner fabric cover is a Dacron material or other sturdy moisture resisting fabric to prevent body fluids and moisture from making contact with the layers of padding, said inner fabric cover adapted to extend from the upper surface of the first layer padding to the lower surface of the third layer padding, forming a hollow donut shaped cover over the layers of padding without any portion of the inner fabric cover intruding into the cut-out portion, said intermediate fabric cover is a cotton fabric adapted to cover the layers of padding within the inner fabric cover; and said washable outer fabric layer is adapted to cover the intermediate fabric cover.

5. The seat cushion as disclosed in claim 1, wherein said inner fabric cover, intermediate fabric cover and outer fabric cover, are irremovably attached upon the seat cushion, said outer fabric cover provided as a material suitable for external cleaning.

6. A therapeutic layered seat cushion, comprising essentially:

a low density first layer padding having an upper surface, a lower surface and a cut-out portion;

a first sheet of fabric mesh bonded to the lower surface of the first layer padding;

a high density second layer padding, having an upper surface bonded to the lower surface of the first layer padding through the first sheet of fabric mesh, a lower surface and a cut-out portion;

a second sheet of fabric mesh bonded to the lower surface of the second layer padding;

a low density third layer padding having an upper surface bonded to the lower surface of the second layer padding through the second sheet of fabric mesh, a lower surface and a cut-out portion;

an encapsulated gel capsule occupying the cut-out portions in said first layer padding, second layer padding and third layer padding;

an inner fabric cover to cover the bonded first layer padding, second layer padding and third layer padding;

an intermediate fabric cover fitted over the inner fabric cover; and a washable outer fabric cover fitted over the intermediate fabric cover.

7. The seat cushion, as disclosed in claim 6 wherein:

said first layer padding and third layer padding are a foam rubber material of the same density, and said second layer padding is a foam rubber product of a higher density than that of said first layer padding and third layer padding, said encapsulated gel capsule is of yet another density; and said first layer and second layer of fabric mesh are nylon netting be suitably porous to allow for penetration of a bonding adhesive, embedding said fabric mesh within said bonding adhesive.

8. The seat cushion, as disclosed in claim 6, wherein said first layer padding, second layer padding and third layer padding are provided with a plurality of cut-out portions, each said cut-out portion having an encapsulated gel capsule.

9. The seat cushion, as disclosed in claim 6, further comprising:

said inner fabric cover is a sturdy moisture resisting fabric preventing body fluids and moisture from making contact with the layers of padding, said inner fabric cover adapted to extend from said upper surface of said first layer padding to said lower surface of said third layer padding, forming a hollow donut shaped cover over the layers of padding without any portion of said inner fabric cover intruding into said cut-out portion containing said encapsulated gel capsule;

said intermediate fabric cover is cotton and adapted to cover the layers of padding within said inner fabric cover; and said washable outer fabric layer is adapted to cover said intermediate fabric cover.

10. The seat cushion as disclosed in claim 6, wherein said inner fabric cover, intermediate fabric cover and outer fabric cover, are irremovably attached upon said seat cushion, said outer fabric cover provided as a material suitable for external cleaning.

* * * * *